United States Patent [19]

Kuhn et al.

[11] Patent Number: 5,074,266

[45] Date of Patent: Dec. 24, 1991

[54] THROTTLE-VALVE APPARATUS FOR AN INTERNAL COMBUSTION MACHINE

[75] Inventors: Lothar Kuhn, Lippstadt; Manfred Bartscht, Salzkotten, both of Fed. Rep. of Germany

[73] Assignee: Hella KG Hueck & Co., Fed. Rep. of Germany

[21] Appl. No.: 608,747

[22] Filed: Nov. 5, 1990

[30] Foreign Application Priority Data

Nov. 6, 1989 [DE] Fed. Rep. of Germany ..... 3936875

[51] Int. Cl.[5] ..... F02D 9/02

[52] U.S. Cl. ..... 123/361; 123/399

[58] Field of Search ..... 123/361, 399; 180/178, 180/179, 197

[56] References Cited

U.S. PATENT DOCUMENTS

| | | | |
|---|---|---|---|
| 4,860,708 | 8/1989 | Yamaguchi et al. | 123/399 |
| 4,860,848 | 8/1989 | Barth et al. | 123/336 X |
| 4,951,772 | 8/1990 | Peter et al. | 123/361 X |
| 4,972,817 | 11/1990 | Wilde et al. | 123/399 |
| 5,002,032 | 3/1991 | Kolberg | 123/399 |

FOREIGN PATENT DOCUMENTS

| | | |
|---|---|---|
| 389649 | 10/1990 | European Pat. Off. . |
| 3711779 | 10/1988 | Fed. Rep. of Germany . |
| 3730239 | 3/1989 | Fed. Rep. of Germany . |
| 3831257 | 3/1989 | Fed. Rep. of Germany . |
| 3813047 | 11/1989 | Fed. Rep. of Germany . |

*Primary Examiner*—Tony M. Argenbright

*Attorney, Agent, or Firm*—Griffin, Branigan & Butler

[57] ABSTRACT

A throttle-valve apparatus involves a throttle valve (D) mounted on a shaft (W) which is coupled to a cable line (S) for rotating the shaft. The apparatus includes a first engaging detent, or stop, mechanism, (A1) having a movable engagement point between the cable line and the shaft, a first coupling apparatus (K1) between the cable line and the shaft, and a positioning motor (M) which creates a throttle-valve apparatus whose operation, in a particular uncomplicated and cost effective manner, increases safety and dependability during operation of a motor vehicle. When the positioning motor is driven to drive the throttle valve it is relieved from overcoming a return force of a spring by the first coupling apparatus which includes a first coupling having a changeable or cancellable driving linkage whereby a driving engagement of the linkage is greatest in an immediate area of the movable engagement point of the detent mechanism.

18 Claims, 4 Drawing Sheets

THROTTLE-VALVE APPARATUS FOR AN INTERNAL COMBUSTION MACHINE

BACKGROUND OF THE INVENTION

This invention relates to a throttle valve for an internal combustion machine which is mounted on a shaft with a cable line, or other linkage member, for rotating the shaft and with at least one return spring coupled to the cable line, a first detent being between the cable line and the shaft, a first coupling apparatus being between the cable line and the shaft and a positioning motor.

Such a throttle-valve apparatus is known from German Offenlegungsschrift DE-OS No. 37 11 779. The throttle valve of this document is mounted on a shaft which is rotatable by a cable line. The cable line is operated on by a return spring with a force in a direction for closing the throttle valve. The throttle valve apparatus additionally has a first detent between the cable line and the shaft whose engagement, or stop, point can be moved with the help of the cable line so that the throttle valve is moveable between its closing position and the stop position. A coupling apparatus is arranged between the cable line and the shaft which here is disclosed as being a spring. For interrupting a motor torque, for example upon the appearance of loss of traction of a driven tire of a motor vehicle, the throttle valve has a positioning motor which can move the throttle valve. The positioning motor is coupled to the shaft via a second detent whose engagement, or stop, point is adjustable with the help of the positioning motor so that the throttle valve is manipulatable in a closing direction.

A particular disadvantage of this system is that when the throttle valve is driven by the positioning motor, the positioning motor has to continually work against the spring force of the spring which couples the cable line to the shaft. Because the spring force increases with further stress thereon, it is necessary to have a positioning motor that provides a high performance, resulting in an expensive apparatus. In this regard, it is additionally disadvantageous that because the positioning motor must be driven to provide greater forces, a life of the positioning motor is reduced so that safety and dependability when operating the motor vehicle, particularly since this involves an apparatus pertaining to safety such as a throttle valve, is reduced.

Further, it is disadvantageous that the positioning motor, when the throttle valve is manipulated by the cable line, is not also automatically driven so that when it is necessary for the positioning motor to intervene in positioning the throttle valve there is an undesirable delay, which can have disadvantageous consequences in a controlled behavior situation, for example, when controlling slippage of a motor vehicle.

It is an object of this invention to provide a throttle valve apparatus which, in an uncomplicated and cost effective system, improves safety and dependability during operation of a motor vehicle and which includes a positioning motor whose operation is relieved from return forces on a throttle-valve.

According to principles of this invention, a throttle-valve apparatus includes a first coupling apparatus which is a first coupling having a changeable, or releasable, driving engagement whereby the driving engagement is greatest in an immediate area of a moveable, or changeable, engagement, or stop, point.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENT

Figure 1:
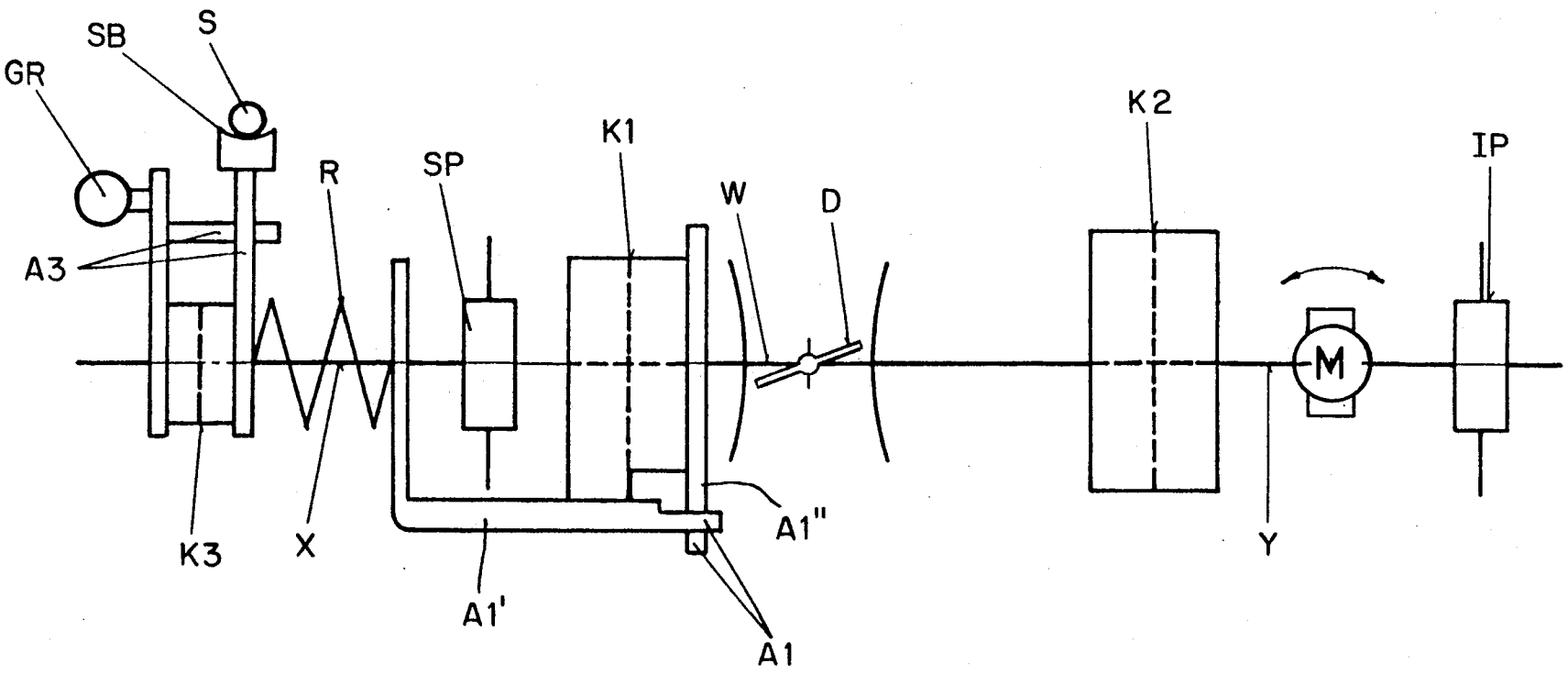
FIG. 1 is a partially schematic side view of a throttle-valve apparatus of this invention.

Similar and similarly-operating elements are identified with the same reference numerals throughout the figures.

FIG. 1 shows a first embodiment of a throttle-valve apparatus of this invention in a partially schematic system drawing.

The throttle valve D is mounted on a shaft, or axle, W which can be rotated by a cable line S. The cable line S is coupled to a disk, wheel, or pulley, SB to provide a particularly uncomplicated linkage. The disk SB is operated on by at least one return spring R with a force directed toward closing the throttle valve D. The disk SB is, at the same time, mounted on a shaft X which is also coupled to a nominal value potentiometer SP which it shifts upon manipulation of the cable line S and the disc SP so that a controlling apparatus, or a diagnostic apparatus, neither of which is shown in the drawings, can be fed a nominal value signal for the position of the throttle valve D. Also mounted on the shaft X is a first part A1′ of a detent, or stop, mechanism, A1 whose engagement, or stop, point can be shifted by the cable line S so that the throttle valve D is moveable between its closed position and the moveable engagement point, or position of the detent mechanism.

A first coupling apparatus K1 is arranged between the first part A1′ and a second part A1″ of the detent A1 which is a first coupling K1 having a changeable or discontinuable driving linkage whereby the driving linkage, or engagement in an immediate area of the changeable engagement, point of the detent mechanism is greater. The second part A1″ of the detent A1 is affixed to a shaft W.

The throttle-valve apparatus of the throttle valve D additionally includes a positioning motor M which is mounted on a shaft Y and which shifts, or adjusts, the position of the throttle valve D via the shaft W in dependence upon given or calculated parameters.

To determine the actual positions of the positioning motor M and the throttle valve D, an actual-value potentiometer IP is arranged relative to the positioning motor M. A second coupling apparatus K2 is arranged between the shaft W and the shaft Y (that is, the positioning motor M) which can drivingly couple the positioning motor M with the shaft W.

In order to manipulate the throttle valve D by means of a speed controller actuation apparatus, which includes a regulator or governor, the disk SB is coupled, or couplable, with the speed controller actuation apparatus GR via a third coupling apparatus K3 which includes a spring or a coupling with changeable or reducible driving linkage. Additionally, the speed controller actuation apparatus GR is coupled to the disk SB via a third detent A3 through which, for one thing it will be made certain that upon manipulation of the throttle valve D by the governor through the third coupling apparatus K3 a non-hesitating intervention of the governor is assured and, for another thing the speed control actuation apparatus GR is operated on by a force from the return spring R in a direction for closing the throttle valve D.

For construction of the first and second coupling apparatus K1, K2 the following exemplary embodiments are described.

The first coupling apparatus K1 shown in FIG. 1 can, for example, be constructed as an electrical, pneumatic, or hydraulic coupling K1 which, in dependence upon signals from the actual value potentiometer IP and the nominal value potentiometer SP will be driven, or controlled, by a, not shown, controlling apparatus or a diagnostic apparatus. If the first and second parts A1', A1" of the first detent A1 are at their engagement point, then the first coupling K1 is closed, or transmitting. As soon as it is necessary to drive the throttle valve with the positioning motor M, the first coupling K1 is opened so that the positioning motor M is relieved, or unloaded, so that the positioning motor M can be uncomplicated and can have reduced performance ratings, thereby resulting in an overall cost effective apparatus.

So that the positioning motor M can be coupled to the shaft W, as well as uncoupled therefrom, the second coupling apparatus K2 is arranged between the shaft Y and the shaft W which can be a second coupling K2 having a changeable, or disengageable, driving linkage.

The second coupling K2 can also be constructed as an electrical, pneumatic, or hydraulic actuateable coupling which is driven by a not shown control or diagnostic apparatus. It is thereby beneficial for the second coupling K2 to be in a driving mode except when the positioning motor M is malfunctioning, so that the positioning motor M always follows turning movements of the shaft W which upon a necessary intervention of the positioning motor M, guarantees that the positioning motor M can shift the shaft W without hesitation. In the case that the positioning motor M should malfunction, or an emergency function must be switched in, the second coupling K2 can be opened so that the throttle valve D can be freely adjusted by the cable line S.

When the first and/or second coupling K1, K2 is constructed as an electrical, pneumatic or hydraulic manipulable coupling, the benefit of very high dependability upon manipulation results as well as a very easy matching with necessary control procedures of the not-shown controlling apparatus, which results in a cost effective apparatus.

Figure 2:
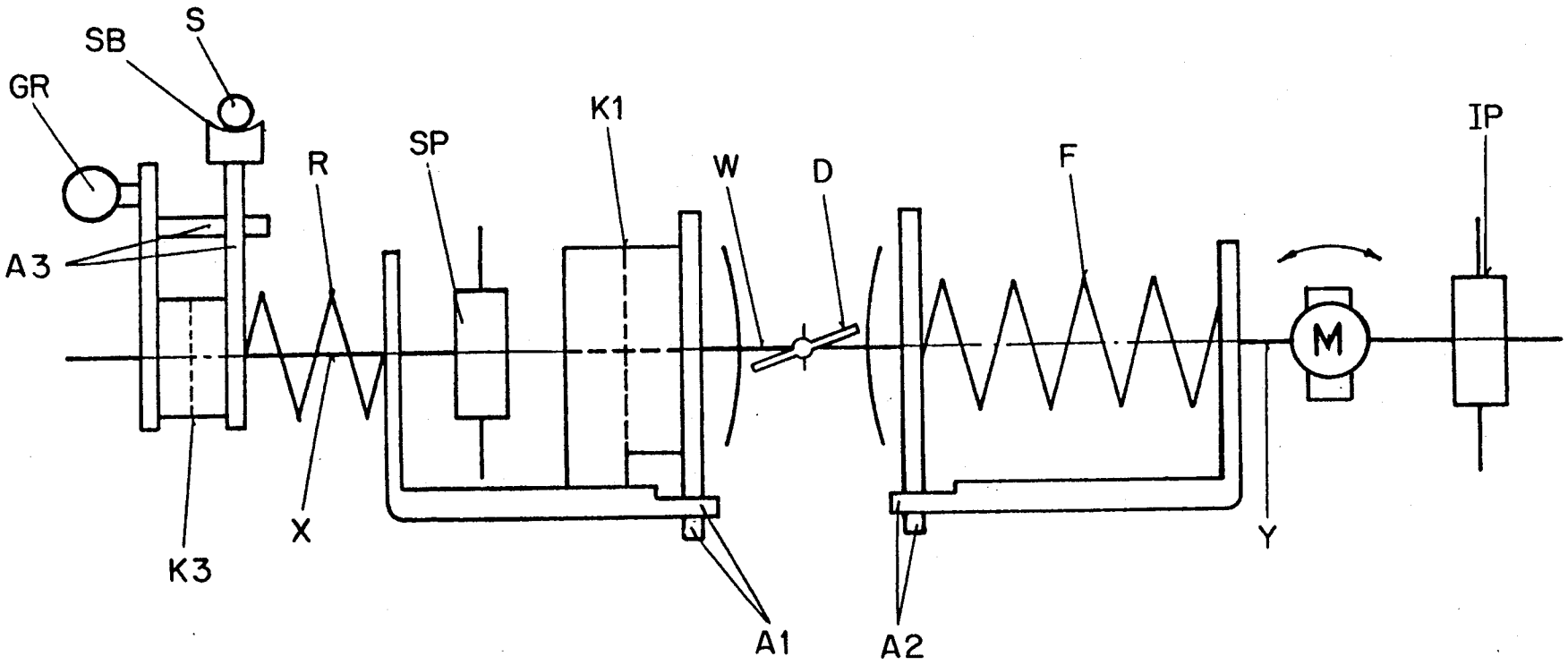
FIG. 2 is a partially schematic side view of a second embodiment of a throttle-valve apparatus of this invention.

The embodiment depicted in FIG. 2 differs from the embodiment of FIG. 1 only in that it employs another embodiment of the second coupling apparatus K2. The second coupling apparatus K2 is here, for a particularly uncomplicated and cost effective embodiment, shown as a spring F through which the shaft W and the shaft Y, and therefore the positioning motor M, are coupled. Upon each shifting adjustment of the shaft W by the cable line S the positioning motor M follows movement of the throttle valve D so that the positioning motor M, at any time, without hesitation, upon being driven by the not-shown control apparatus can rotate the throttle valve D which, particularly in a safety-relevant control apparatus such as a drive slippage control apparatus, provides high safety benefits. To increase safety upon a necessary driving of the throttle valve D by the positioning motor M, the shaft Y can be coupled with the shaft W via a second detent, or stop mechanism, A2 whose engagement point is predeterminable with the help of the positioning motor, so that the throttle valve is manipulatable in a closing direction.

Figure 3:
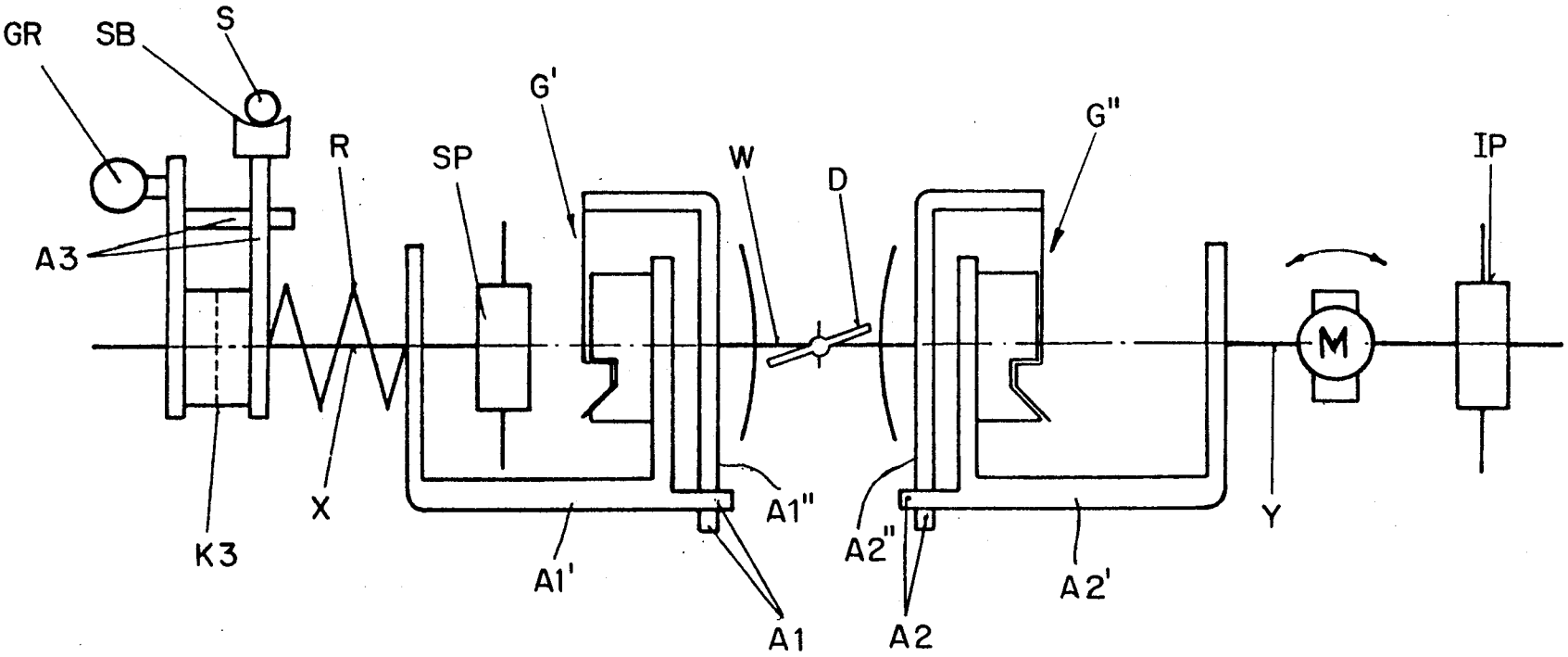
FIG. 3 is a partially schematic side view of a third embodiment of a throttle-valve apparatus of this invention.

A further embodiment of the throttle-valve apparatus of this invention is depicted in FIG. 3. The FIG. 3 embodiment only differs from the FIG. 1 and FIG. 2 embodiments by refinements to the first and second coupling apparatus K1 and K2. The coupling apparatus K1 and K2 are here, for example, shown as rest-slide couplings G' and G", which are only roughly sketched in FIG. 3. The rest-slide couplings G' and G" are formed and arranged so that in the immediate area, region, or range of the engagement points of the detent, or stop, mechanisms A1, A2 the first and second parts A1', A1" and A2', A2" of the detents A1 and A2 engage one another so that in this position when the throttle valve is manipulated by the cable line S a fixed coupling exists between the shaft Y and the shaft W as well as between the shaft W and the shaft X. Upon a necessary intervention of the positioning motor M to shift the throttle valve D, the shaft W is moved by a force from the positioning motor M which is large enough to overcome a resting, or engaging, force of the rest-slide coupling G' with regard to the first detent A1 so that after the existing resting force is overcome by the positioning motor M, it is only necessary that a force for shifting the throttle valve D against a sliding force of the rest-slide coupling G' be produced. For this reason, the positioning motor can have a smaller performance rating resulting in an apparatus which is simpler and cost effective.

Also the second coupling apparatus K2 can be formed as a rest-slide coupling G" which provides firmest linkage in the immediate range of the engagement point of the second detent, or stop mechanism, A2 and thereby ensures that the positioning motor M follows movements of the throttle valve D. In case of improper functioning of the positioning motor M or upon activation of an emergency function operation for the throttle valve D, overcoming a rest force ensures that the throttle valve D can be freely moved by the cable line S so that a high degree of safety results from operation of the motor vehicle.

Figure 4:
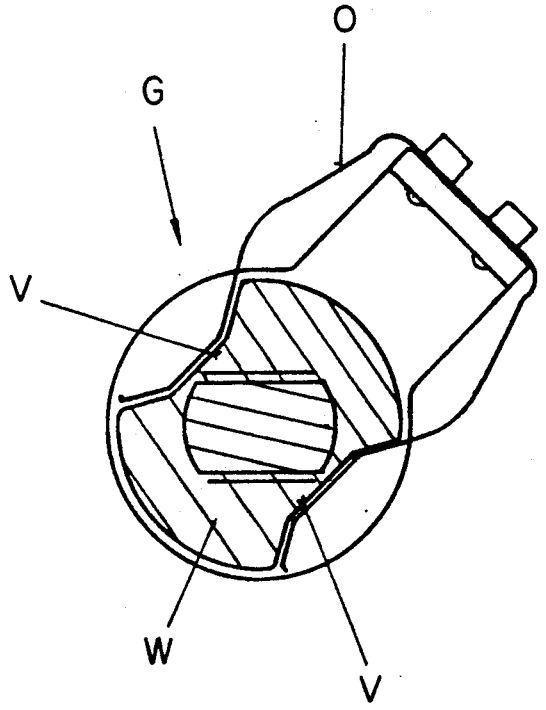
FIG. 4 is a simplified sectional view of a rest-slide coupling for use in the embodiment of FIG. 3.

An uncomplicated and cost effective example of a rest-slide coupling G of the first detent A1 is shown in FIG. 4. Depending upon the arrangement of the rest-slide coupling G, the shaft W or the shaft X can have two rest depressions V which, with regard to predetermined positioning of the throttle valve, have a predetermined depth and a predetermined width. A two arm, omega formed, spring O is provided to form a rest-slide coupling G which is attached to the respective other shaft X or W and whose free, inwardly bending arms, can grip into the rest depressions, or couplings, or can slide on an outer surface of the respective shaft X or Y. The construction of the rest depressions V and the omega formed spring O can vary depending upon the necessary resting forces, driving forces and friction forces of the shafts W, X, Y. The rest-slide coupling of the second detent A2 can have an identical or similar construction.

The possible construction forms and combinations of the coupling apparatus K1, K2, K3 are not limited in the inventive throttle-valve apparatus to the examples shown in FIGS. 1-3. Depending upon necessary construction forms, the types of couplings of the coupling apparatus K1, K2, K3 vary so that other respective combinations of the coupling apparatus and types of coupling apparatus K1, K2, K3 can result.

The positioning motor M, in a particularly cost effective construction, can be an electric motor. The positioning motor M can, however, also be a pneumatically manipulated motor.

As is shown in FIGS. 1 through 3 the positioning motor M and the cable line S can be positioned on opposite sides of the throttle valve D. In another embodiment, the cable line S and the positioning motor M can be positioned on the same side of the throttle valve D.

Operation of the throttle-valve apparatus for an internal combustion machine is briefly described below.

As an example, in an E-gas (electrically operated throttle valve apparatus) or a drive slippage control operation for a motor vehicle, the positioning motor M is used to, in dependence upon predetermined or calculated parameters, adjust motor torques via the throttle valve D of the motor vehicle. This intervention into motor torque of a motor vehicle requires a high degree of dependability in driving, or controlling the throttle valve D with the positioning motor M. Upon normal operation of the motor vehicle, the throttle valve D is adjusted via the cable line S which is moved by a gas pedal. The cable line S is coupled with at least one return spring R which, upon releasing the gas pedal, shifts the throttle valve D into a closed position. When the throttle valve D is adjusted by the cable line S, it is necessary that the shaft W, on which the throttle valve D is mounted, be firmly coupled with the shaft X on which the, for example, pulley SB is mounted to which the cable line S is attached.

Under operating conditions during which the throttle valve D is to be adjusted by the positioning motor M, it is beneficial that the strong linkage between the shaft W and the shaft X be relieved so that the positioning motor does not have to overcome a high return force in order to shift the throttle valve D. Because of this, the first coupling apparatus K1 is provided which, in a predetermined position of the parts of detent A1 produces a firm, or strong, linkage of the shaft W to the shaft X and which upon intervention of the positioning motor M releases, or discontinues, this firm linkage.

So that the positioning motor M continuously follows movements of the throttle valve D when the throttle valve D is being driven by the cable line S, the second coupling apparatus K2 is provided which, except in the case a malfunctioning of the positioning motor or if an emergency function operation of the throttle valve is turned on, couples the positioning motor M to the shaft W. This provides the benefit that the positioning motor M, upon a necessary driving of the throttle valve D by the positioning motor M, shifts the throttle valve without hesitation and very exactly. Upon an E-gas operation for a motor vehicle the positioning motor shifts the throttle valve D between the closed position and a maximum open position. With an apparatus for controlling drive slippage it is, however, beneficial if the positioning motor M can set the throttle valve only between the closed position and a momentary maximum position of the throttle valve which is set by the cable line.

To oversee trouble free operation of the positioning motor M, the first and second coupling apparatus K1, K2 and positioning of the throttle valve D, the nominal value potentiometer SP of the cable line S is provided from which a voltage can be obtained indicating a nominal value for the position of the throttle valve D and the actual potentiometer IP of the positioning motor M is provided on which can be obtained a voltage corresponding to the actual position of the throttle valve D. These voltages can be fed to a diagnostic apparatus which can be part of a controlling apparatus and which upon deviations appearing, can, for example, take the positioning motor M out of operation and/or can open and/or close the first and/or the second coupling apparatus K1, K2, can give off error signals, and can activate emergency circuits.

The speed controller actuation apparatus GR can be coupled over the third coupling apparatus K3 and the third detent, or, stop mechanism, A3, in an uncomplicated and cost effective manner, to the pulley or disk SB so that the throttle valve D is manipulatable through a governor without, for example, sacrificing drive-slippage control and a corresponding control with the positioning motor M.

It is beneficial that the first coupling apparatus includes a coupling which has a changeable, or reducible driving linkage whereby the driving linkage is greatest in the immediate range, or area, of a movable engagement, or stop, point because in this manner, the positioning motor can shift the position of the throttle valve with expenditures of only small amounts of power so that the positioning motor, in a particularly uncomplicated and cost effective manner, can have lesser performance capability and, additionally, because the positioning motor is relieved from a large return force of the throttle valve, dependability and safety during operation of a motor vehicle is increased while the lifetime of the positioning motor is increased.

Because a second coupling apparatus is arranged between the shaft and the positioning motor, which drivingly couples, or can drivingly couple, the positioning motor to the shaft, the benefit results that the positioning motor, in a particularly uncomplicated and cost effective manner, can manipulate the throttle valve as well as, upon manipulation of the throttle valve by the cable line, is forced to follow positions of the throttle valve so that by each necessary manipulation of the throttle valve by the positioning motor an immediate intervention is possible whereby control behavior, a drive-slippage control behavior for example, is substantially improved. In this regard, it is beneficial when the second coupling apparatus comprises a spring which is arranged between the positioning motor and the shaft because in this manner a particularly uncomplicated and cost effective construction form results which has a particularly high dependability.

It is beneficial that the second coupling apparatus includes a second coupling which has a changeable, decreasible, or releasable driving linkage because in this manner, a particularly dependable driving of the positioning motor by a manipulation of the throttle valve with the cable line is assured as well as, for example, in the case when the positioning motor would be blocked, movement of the throttle valve by the cable line is assured.

Because the first and/or second couplings are each a rest-slide coupling, the benefit exists that for a predetermined position of the shaft to the cable line or the positioning motor, a firm coupling, or linkage between the shaft and the cable line or the shaft and the positioning motor is assured and for other positions of the shaft to the cable line or the shaft to the positioning motor only a small force is necessary to turn the shaft with the cable line or the positioning motor.

Because the rest-slide coupling includes a two armed omega-formed spring and at least two resting depressions on one of the shafts, the benefit results of a particularly uncomplicated and cost effective construction for the rest-slide coupling with a high dependability.

It is particularly beneficial if the first and/or second coupling is a pneumatically, electrically, or hydraulically manipulated coupling because in this manner a particularly dependable coupling and releasing of the cable line to the throttle valve and/or the positioning motor to the throttle valve is assured by which safety and dependability during operation of the motor vehicle is substantially increased without costs for the throttle valve apparatus excessively increasing.

Because an actual value potentiometer is arranged for the positioning motor, the benefit arises that when the positioning motor reliably follows movements of the throttle valve the actual positions of the throttle valve and the positioning motor can always be dependably determined and fed to a controlling apparatus.

In this regard, it is beneficial that a nominal value potentiometer is arranged relative to the cable line because in this uncomplicated and cost effective manner, the nominal setting of the throttle valve can be made certain.

It is particularly beneficial that a diagnostic apparatus is coupled to the actual value potentiometer and the nominal value potentiometer because in this manner improper positioning of the throttle valve and/or the positioning motor and/or the first or second coupling apparatus can be recognized in an uncomplicated and dependable manner, error alarms can be given out, and an emergency circuit can be activated whereby dependability and safety during operation of a motor vehicle is increased.

It is beneficial that a speed controller activation apparatus is coupled to the cable line because in this uncomplicated and cost effective manner a governor is coupled with the throttle valve so that the motor vehicle has at its disposal, in addition to manipulation of the throttle valve via the cable line which is attached to a gas pedal, also manipulation via the governor as well as the positioning motor for a drive-slippage control function, for example.

Because the activation apparatus is drivingly coupled over the third coupling apparatus, which includes a spring or a coupling having changing or decreasing driving linkage with the cable line, the benefit arises that the governor in a particularly uncomplicated and dependable manner can be coupled to the throttle valve whereby a high dependability results during operation of the motor vehicle. The speed controller, or governor, actuation apparatus can thereby, during operation of the throttle valve by the cable line be made to follow movement of the cable line whereby a necessary intervention of the governor results without hesitation for shifting the throttle valve. In this regard, it is beneficial that a third detent be arranged between the activation apparatus and the cable line because in this manner it is assured that during control of the throttle valve by the governor a dependable coupling between the governor and the shaft for an adjustment of the throttle valve in an open direction is created whereby, at the same time, a return of the speed controller actuation apparatus (governor) through the return spring is assured for particularly high safety during operation of the motor vehicle.

It is beneficial that the cable line is coupled to a disk or pulley, in which manner a particularly uncomplicated and cost effective coupling of the cable line results.

It is particularly beneficial that a second detent, or stop mechanism, is arranged between the shaft and the positioning motor because this assures that when the throttle valve is driven by the positioning motor the positioning motor, without hesitation and with a high certainty can manipulate in a closing direction.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed or defined are as follows:

1. In a throttle-valve apparatus for an internal combustion machine of a type comprising a throttle valve mounted on a shaft coupled to linkage means for rotating said shaft, said linkage means including a return spring, there being a first detent mechanism between the linkage means and the shaft with a movable first engaging point, a first coupling apparatus between the linkage means and the shaft and a positioning motor, the improvement wherein:

the first coupling apparatus includes a coupling which has a changeable driving linkage whereby a driving engagement of the linkage is greatest in an immediate area of the movable first engaging point.

2. In a throttle-valve apparatus as in claim 1 wherein a second coupling apparatus is arranged between the shaft and a positioning motor which can drivingly couple the positioning motor to the shaft.

3. In a throttle-valve apparatus as in claim 2 wherein the second coupling apparatus comprises a spring arranged between the positioning motor M and the shaft.

4. In a throttle-valve apparatus as in claim 3 wherein there is a second detent between the positioning motor and the shaft having a second engaging point and wherein the second coupling apparatus includes a coupling which has a changeable driving linkage whereby a driving engagement is greatest in an immediate area of the second engaging point.

5. In a throttle-valve apparatus as in claim 4 wherein at least one of the first and second couplings is respectively formed as a rest-slide coupling.

6. In a throttle-valve apparatus as in claim 5 wherein the rest-slide coupling comprises a two arm omega formed spring which engages depressions in a shaft.

7. In a throttle-valve apparatus as in claim 4 wherein at least one of the first and second couplings is actuatable pneumatically.

8. In a throttle-valve apparatus as in claim 6 wherein the positioning motor manipulates an actual-value potentiometer.

9. In a throttle-valve apparatus as in claim 8 wherein the linkage means includes a nominal value potentiometer.

10. In a throttle-valve apparatus as in claim 9 wherein a diagnostic apparatus is coupled to the actual-value potentiometer and to the nominal value potentiometer.

11. In a throttle-valve apparatus as in claim 10 wherein a speed controller activation apparatus is coupled to the linkage means.

12. In a throttle-valve apparatus as in claim 11 wherein the speed controller activation apparatus is coupled to the linkage means via a third coupling apparatus which includes a coupling with changeable driving linkage.

13. In a throttle-valve apparatus as in claim 12 wherein a third detent is arranged between the speed controller activation apparatus and the linkage means.

14. In a throttle-valve apparatus as in claim 13 wherein the linkage means includes a tether attached to a disc.

15. In a throttle-valve apparatus as in claim 10 wherein a second detent is arranged between the shaft and the positioning motor.

16. In a throttle-valve apparatus as in claim 4 wherein at least one of the first and second couplings is actuatable electrically.

17. In a throttle-valve apparatus as in claim 4 wherein at least one of the first and second couplings is actuatable hydraulically.

18. In a throttle-valve apparatus as in claim 11 wherein the speed controller activation apparatus is coupled to the linkage means via a spring apparatus with changeable driving linkage.

* * * * *